United States Patent [19]

Hix et al.

[11] 4,139,643

[45] Feb. 13, 1979

[54] SNACK FOOD PACKAGE

[75] Inventors: Diana L. Hix; Charles L. Johnson, both of Cincinnati; Harold D. Abner, Hamilton, all of Ohio

[73] Assignee: The Procter & Gamble Company, Cincinnati, Ohio

[21] Appl. No.: 857,941

[22] Filed: Dec. 6, 1977

[51] Int. Cl.[2] ..... B65D 5/54; B65B 23/00

[52] U.S. Cl. ..... 426/122; 206/620; 206/627; 206/628; 229/DIG. 3; 426/124; 426/126

[58] Field of Search ..... 206/620, 629, 632, 628, 206/630, 631, 627; 426/122, 123, 124, 115, 396, 126; 229/DIG. 3

[56] References Cited

U.S. PATENT DOCUMENTS

| | | | |
|---|---|---|---|
| 3,212,907 | 10/1965 | Caprioli | 426/115 X |
| 3,615,711 | 10/1971 | Markus et al. | 206/629 X |
| 3,625,351 | 12/1971 | Eisenberg | 206/620 X |
| 3,973,045 | 8/1976 | Brandberg et al. | 229/DIG. 3 X |
| 4,011,347 | 3/1977 | Griffith | 220/441 X |

FOREIGN PATENT DOCUMENTS

| | | | |
|---|---|---|---|
| 2609910 | 9/1977 | Fed. Rep. of Germany | 229/DIG. 3 |

*Primary Examiner*—Steven L. Weinstein

*Attorney, Agent, or Firm*—John V. Gorman; Richard C. Witte; Thomas H. O'Flaherty

[57] ABSTRACT

A hermetically sealed pouch which is pleated, provided with a line of weakness and a tear initiating cut adjacent the line of weakness. The line of weakness extends completely around the pouch near the top of the package. A sealed area surrounds the cut to establish a barrier between the cut and the pouch interior. In one embodiment two parallel lines of weakness are used and the cut is made in the material which intervenes.

1 Claim, 7 Drawing Figures

SNACK FOOD PACKAGE

BACKGROUND OF THE INVENTION (1) Field of the Invention

This invention relates to hermetically sealed pouches and more particularly to a pouch constructed of a multiply laminate for use in packaging snack food products.

(2) Description of the Prior Art

Packages constructed from flexible materials such as laminates are well known. Various products have been placed in hermetically sealed pouches to preserve their freshness and opening means have been provided for gaining access to the pouch interior. This is shown, for example, in U.S. Pat. No. 3,559,800, which issued to John Parkman Butler on Feb 2, 1971, in connection with a pouch made from a laminate wherein the inner ply is adhered to the outer ply only in selected locations and a line of weakness is impressed in the inner ply for ease in opening the pouch. Pouches made from fully laminated plies are, of course, also well known and have been provided with opening devices of various sorts, as illustrated in U.S. Pat. No. 3,426,959, which issued to Jerome H. Lemelson on Feb. 11, 1969, and wherein a tear opening is defined by a line portion of the wall of the package, such line portion being of reduced thickness and having means disposed therealong for effecting a controlled separation along the line portion. In one embodiment the use of a pair of thinned, parallel lines of weakness on the sides of a tearstrip is disclosed U.S. Pat. No. 3,186,628, issued to William A. Rohde on June 1, 1965, also concerns a package formed of a flexible packaging material. The packaging material comprises a thermoplastic film having formed therein an imperforate continuous, or substantially continuous, groove line which is relatively thinner than the remaining body portion of the film and which provides a means by which a wall of the package may be ruptured for access to the package contents. The thermoplastic film can be employed alone or supported by lamination to other films or sheet material. Various means can be used to form the groove line; for example, the Rohde patent suggests probes projecting into the path of the thermoplastic film as it is being extruded or, alternatively, using an electrically or otherwise heated bar. The prior art also illustrates other more sophisticated ways in which similar line of weakness can be formed. One such disclosure is made in U.S. Pat. No. 3,909,582, which issued to William Edmund Bowen on Sept. 30, 1975, wherein a laser beam is used to score (i.e. provide a thinned groove in) a layer of plastic film in a multilayer laminate. The score line functions as a line of weakness along which the laminate can be torn and, thus, functions as a package opening device. With respect to tear initiating means, such is generally old in the art, others having used notches or slits for such function.

SUMMARY OF THE INVENTION

In accordance with the present invention there is provided a pouch made of a flexible material. The pouch has a longitudinally extending fin seal and top and bottom transverse heat seals. The pouch has a full length pleat formed therein and held flat. The pleat has an inner fold which faces one end of the top heat seal. A line of weakness extends around the package near the top heat seal and a cut is made in the material near the line of weakness and on the end to which the inner fold faces. The pouch is sealed around the cut.

BRIEF DESCRIPTION OF THE DRAWINGS

While the specification concludes with claims particularly pointing out and distinctly claiming the subject matter regarded as forming the present invention, it is believed the invention will be better understood from the following description taken in connection with the accompanying drawings in which:

DESCRIPTION OF THE PREFERRED EMBODIMENT

Figure 1:
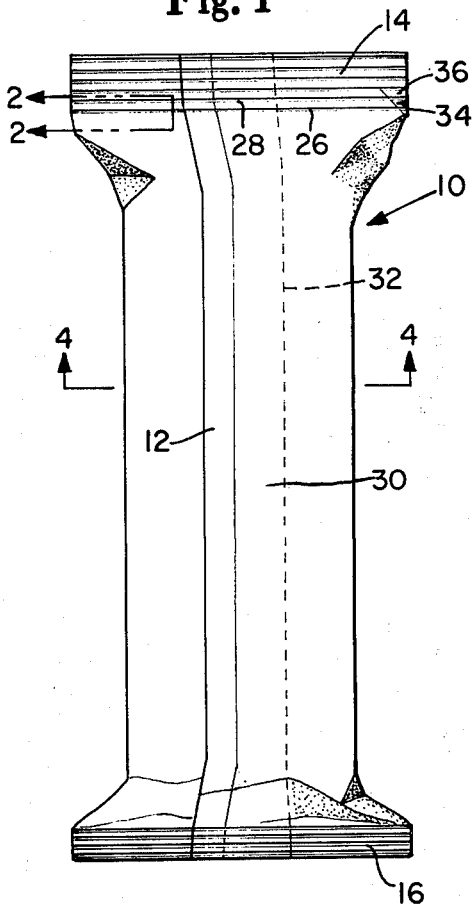
FIG. 1 is a side elevational view of a hermetically sealed pouch of the present invention.

Referring to FIG. 1 there is shown a hermetically sealed pouch 10 of the present invention. The pouch is constructed of a flexible, heat sealable material and is provided with a fin seal 12, a top heat seal 14 and a bottom heat seal 16, each of which can be about ⅜" wide.

Figure 2:
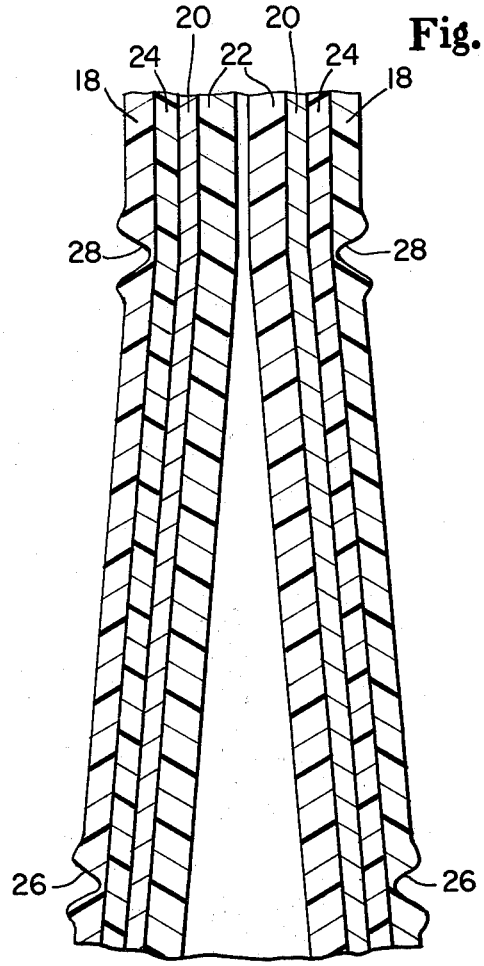
FIG. 2 is a greatly enlarged, fragmentary, cross sectional view of the pouch taken along the line 2—2 of FIG. 1 and showing the structure of the pouch material and the lines of weakness formed therein.

As shown most clearly in FIG. 2, the material comprising the pouch can comprise a laminate, which in the preferred mode consists of an outer ply 18, a central ply 20 and an inner ply 22 of a heat sealable plastic. The outer ply 18 is the strength member of the laminate and can be a thermoplastic material such as polypropylene having a thickness of from 0.0005" to 0.001", preferably about 0.00075". Alternatively, the outer layer can be a high strength polyester such as DuPont's Mylar, a polyethylene terephthalate, having a thickness in the same range. The central ply is preferably a dead soft aluminum foil having a thickness in the range of about 0.00030", to 0.00070", preferably about 0.00035". The inner ply must be heat sealable and can comprise any suitable thermoplastic, a preferred type being a modified polyethylene film sold by DuPont of Canada under the Trade Mark Superlam, which is described as a member of the Sclair film family. This is a material which provides good flex-crack resistance, a desirable property of inner ply 22. Inner ply 22 can range in thickness from about 0.0005" to about 0.003", preferably from 0.001" to 0.002" thick. Alternative materials include low density polyethylene, polypropylene and the like. Intermediate the outer ply 18 and central ply 20 is another thermoplastic ply 24 which can be low density polyethylene about 0.0005" thick or, alternatively, ethylene acrylic acid copolymer (EAA) or DuPont's ionomer sold under the Trade Mark Surlyn, both of which bond readily to the central ply 20.

Such laminates can be readily prepared by those skilled in the art. For example, the polypropylene film can be primed with a polyethylene-imine type primer (such as sold by Champion Packages of Minneapolis, Minn., under the designation MS 725) and then have the thermoplastic ply 24 of EAA extruded thereon. The central foil ply 20 can be brought into contact with the EAA extrudate immediately thereafter, the foil ply 20 then coated with a polyurethane curing adhesive (such as sold by Champion Packages' trade designation of MS 754) and the inner ply 22 of Sclair joined thereto. The foil-to-Sclair bond described needs several days to set up before slitting. The bond strength between each ply is preferably high, especially between the central foil ply 20 and the inner heat sealable ply 22. This is helpful in laminated structures in which lines of weakness are formed therein, as is the case of the present invention, to assure easy tearing. Delamination interferes with clean separation along the predetermined line of fracture.

Figure 3:
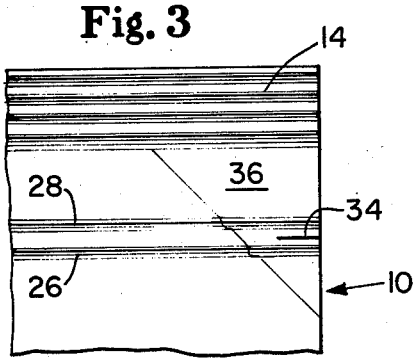
FIG. 3 is an enlarged, fragmentary elevational view illustrating the arrangement for opening the pouch of the present invention.

As also shown in FIGS. 1, 2 and 3, transverse parallel lines of weakness 26, 28 are formed across the fin seal 12 and the balance of the pouch 10 laminate near the top heat seal 14. The lines of weakness 26, 28 are spaced by a small distance, for example by ⅛", and each has its various parts in general alignment, as in parallel planes extending transversely across the pouch 10.

The lines of weakness 26, 28 can be formed by thinning of the laminate material along such lines. As shown, the lines of weakness 26, 28 comprise grooves made in the outer ply 18, preferably by the application of heat and pressure. This can be done by pressing a heated nichrome wire into the outer surface and across the full width of the laminate prior to pouch 10 formation. With the type of laminate described, it has been found that if a nichrome wire having a diameter of 0.0285" is heated to from between about 420° F. and 550° F. and is pressed into the outer ply 18 for about 0.04 to about 0.05 seconds, at a pressure in the range of from about 70 to about 100 psi., lines of weakness 26 and 28 can be produced which facilitate easy tearing and yet do not affect the integrity of the pouch 10. Preferably, the grooves comprising lines of weakness 26 and 28 extend substantially through the outer ply 18 but do not penetrate thermoplastic ply 24 to any significant extent.

As indicated in the introductory matter hereinabove, lines of weakness can be formed in a variety of ways to produce the desired result. In connection with the above described heat and pressure technique, it can simply be expressed as uniformly contacting the outer ply 18 of the laminate with a heated wire, heated machined bar or the like so as to melt and with light pressure create a narrow channel in the outer ply 18 of the material. This channel should be perpendicular to the length of the material comprising the pouch 10 so that the various parts of the channel are aligned as both sides of the material are brought together and united in a fin seal.

Figure 4:
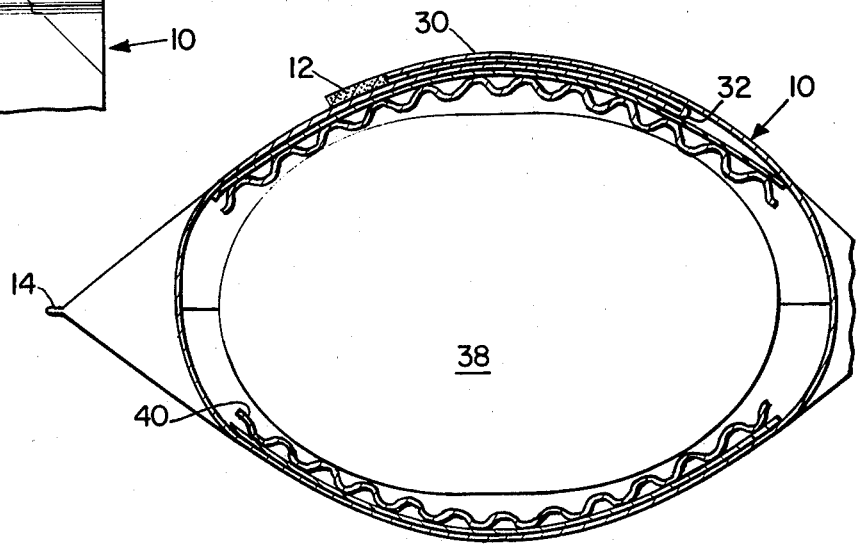
FIG. 4 is an enlarged fragmentary transverse sectional view of the pouch of FIG. 1, taken along line 4—4 thereof.

FIGS. 1 and 4 show that the laminated pouch material is formed into the pouch with a full length pleat 30 therein. In the sealed condition of the pouch 10, the pleat 30 is held in a flat condition. An inner fold 32 of the pleat also extends full length of the pouch 10 and, as shown more particularly in FIG. 4, can be said to face one side or edge of the pouch 10, i.e. the exterior surface of the interior fold 32 faces toward the right.

FIGS. 1 and 3 illustrate the presence of a tear-initiating cut 34 intermediate the lines of weakness 26, 28 near the end of the top heat seal 14 toward which the inner fold faces, the right end as viewed in the drawings. The cut 34 need only be of sufficient length to assure the start of the tearing and, for instance can be 1/16" long. Its vertical position on the pouch 10 can be anywhere in alignment with or between the lines of weakness 26, 28. The use of parallel lines of weakness 26, 28 assures that the tear will intersect a line of weakness, whatever direction the tear starts along initially.

In order to block gas and vapor transmission from the cut 34 to the pouch 10 interior a barrier seal 36 is made throughout the triangular area shown. The shape of the seal 36 is not critical so long as it isolates the cut 34 from the the pouch 10 interior. For example, a C-shaped line of seal interconnecting points on the right side of the pouch 10 above and below the cut 34 and circumscribing the cut 34 would be just as satisfactory as the triangular seal shown.

Although the illustrated embodiment shows two lines of weakness 26, 28 and this arrangement alleviates much of the criticality of registration of the cut in preparing the pouch 10, it will be understood that a single line of weakness could, alternatively, be used, provided the tear initiating cut is carefully placed closely adjacent the line of weakness, preferably in direct alignment therewith or within a 1/16" distance thereabove since the propensity of the consumer is to tear towards the body of the pouch 10. This would cause the tear to intersect the line of weakness and thereafter the tear will follow such line. As indicated above and for the reasons stated, however, the illustrated arrangement with two parallel lines of weakness 26, 28 is preferred.

The pouch 10 of the present invention is particularly well adapted for use where a sealed package should enwrap the contents as snugly as possible but wherein there is a need for ample room for access to the package contents following opening by the consumer. A prime example of such a combination of requirements is found in connection with snack foods, where consumers frequently eat the product, piece by piece, directly from the package in which it is marketed. The sealed wrap should be designed to minimize as much as possible the void space therein and, thus, the quantity of oxygen and water vapor included in the package since these promote oxidative rancidity and staling. Even if an inert gas atmosphere is provided in the sealed package, it is desirable to reduce the quantity of the gas used in the interests of economy. A relatively tight fit of the pouch 10 around its contents will also help to immobilize the contents and prevent breakage during handling. On the other hand, as indicated above, the consumer frequently needs additional room in the package so as to reach in and secure the contents.

Figure 7:
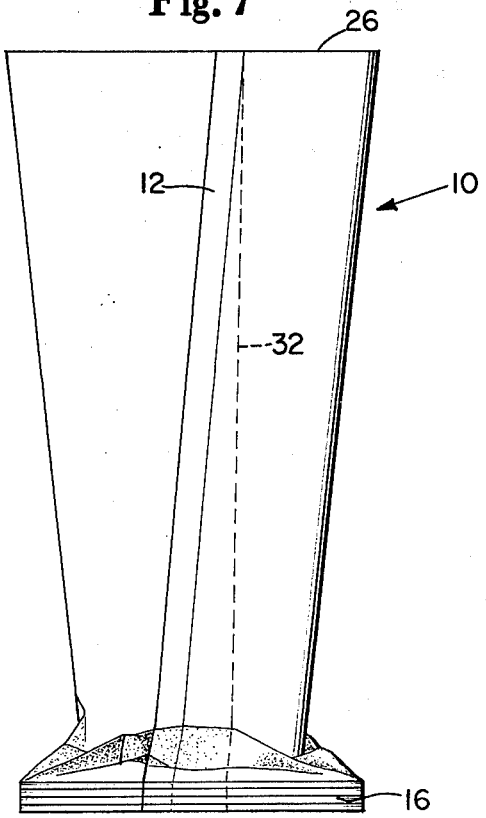
FIG. 7 illustrates a pouch of the present invention following opening of the top thereof and unfolding of the upper part of the pleat to permit easy access to the pouch interior.

These criteria are met by the pouch 10 of the present invention through the provision of the pleat 30. In the sealed condition of the pouch 10, the pleat 30 remains flat, whereas following opening the top of the pleat 30 can be spread, as shown in FIG. 7, to increase the girth of the opened pouch 10, thereby permitting ready access to the contents. In addition, the use of lines of weakness 26, 28 assure that the opening is neat and that sufficient material will be left at the top of the opened pouch 10 to permit the mouth thereof to be closed by means of folds made by the consumer after consuming a portion of its contents.

Figure 5:
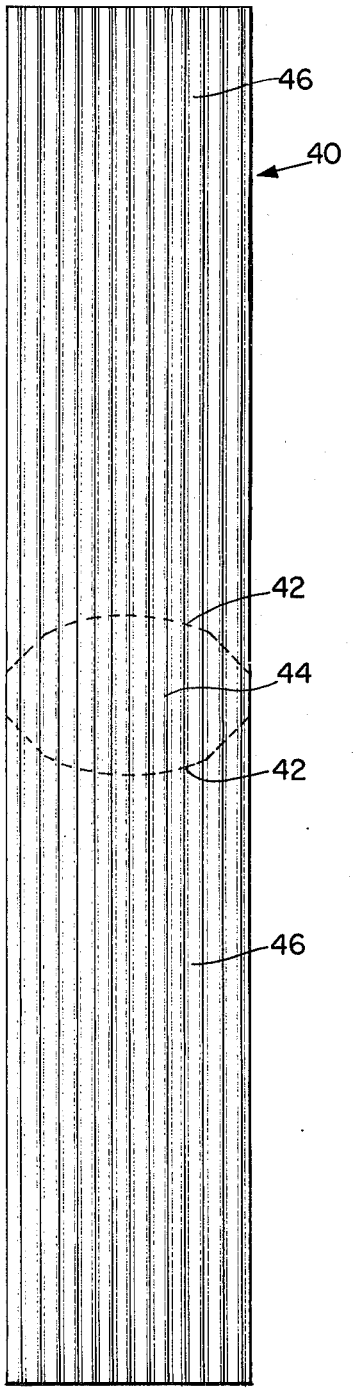
FIG. 5 is a plan view of a protective liner which can be used in pouches of the present invention.
Figure 6:
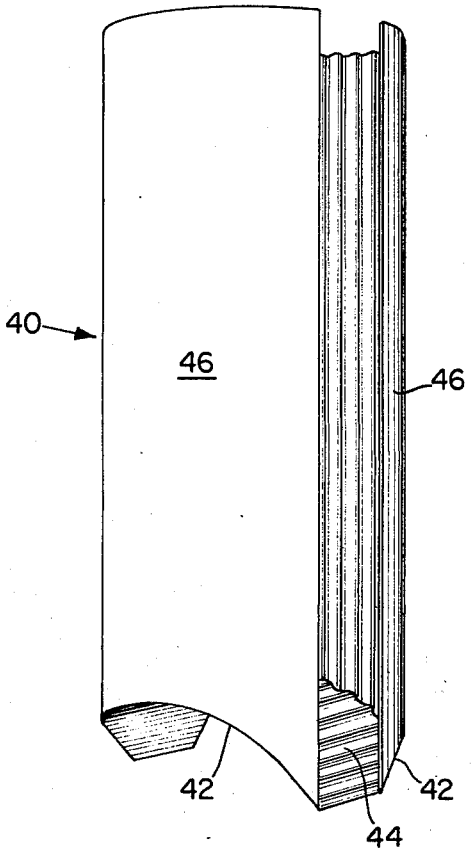
FIG. 6 is a perspective view of the protective liner of FIG. 5 formed and ready to receive the contents to be packaged therein.

Referring to FIGS. 4, 5 and 6, there is shown an arrangement for packaging a chip-type snack food product in the pouch 10. A stack 38 of generally elliptical cross section comprising frangible, uniformly sized and shaped chips, for example potato chips, is carried by a protective line 40 which is adapted to protect the stack 38 from chip breakage due to drops and lateral impacts.

The liner 40 comprises an elongated sheet of single face corrugated paper, the corrugations of which extend lengthwise, provided with a pair of spaced, oppositely disposed, centrally located, outwardly bowed, lines of weakness 42, for example, score lines, impressed across its width. The lines of weakness 42 divide the liner into a central support portion 44, which is slightly larger than the transverse section of stack 38, and end portions 46. The liner is formed as shown in FIG. 6 by folding the end portions 46 upwardly, out of the plane of support portion 44, while flexing them transversely into a curved surface similar in cross section to the curvature of the adjacent line of weakness 42. This produces the illustrated tubular conformation, the support surface 44 of which is bowed widthwise of the liner 40 into a downwardly concave condition. The stack 38 rests on the support portion 44 within the confines of the formed liner 40 and the combination is enveloped by the pouch 10, as will be understood by reference to FIG. 4.

With the illustrated product and packaging arrangement, where the stack 38 has a major diameter of about $2\frac{1}{2}''$, a minor diameter of $1\frac{7}{8}''$ and a height of about $7\frac{1}{2}''$, the liner 40 can have dimensions of about $3\frac{1}{4}''$ by $17\frac{1}{8}''$. The pouch 10 for such contents can be made from a piece of the described laminate $11\frac{1}{2}''$ in length and width. A pleat 30 measuring $\frac{7}{8}''$ on each leg, thus adding $1\frac{3}{4}''$ to the girth of the mouth of the pouch 10 following opening can be used. This results in a mouth having a girth of about $10\frac{3}{4}''$, which is believed to be comfortable for access by most men and women. If the seals 14 and 16 are about $\frac{3}{8}''$ wide and the lines of weakness 26, 28 are about $\frac{1}{8}''$ from the top seal 14, the top chip of the stack 38 will be about $1\frac{5}{8}''$ from the mouth of the pouch 10, following opening. This is sufficient to permit reclosure of materials having deadfold properties such as those of the described laminate, following removal of some chips by the user.

The pouch 10 of the present invention may be prepared by hand in a manner which will be understood by those skilled in the flexible packaging art or, alternatively, can be produced on vertical form, fill and seal machines, the operations and capabilities of which are also well known. In the latter case, the liner 40 and stack 38 can be simultaneously fed through the mandrel of such machine in timed relation to the formation and sealing of each pouch 10.

While the particular preferred embodiment of the present invention has been illustrated and described, it will be obvious to those skilled in the art that various changes and modifications can be made without departing from the spirit and scope of the invention. It is intended to cover in the appended claims all such changes and modifications that are within the scope of this invention.

We claim:

1. A snack food package comprising a stack of frangible, uniformly sized and shaped, chip-type snack food products, a protective liner adapted to support and protect the stack, and an enveloping pouch constructed of a foil laminate having low permeability to vapors and gases and which is resistant to greases and oils, said laminate comprising an inner, heat sealable ply and an outer, high strength ply of thermoplastic material, a pair of transverse lines of weakness formed in said foil laminate by thinning of the outer ply along a line which extends full width near the top of the laminate and which in the formed pouch have their various parts in general alignment, said lines of weakness being spaced a small distance apart, a fin seal extending lengthwise of the pouch and bonding the side edges of the laminate together, a full length pleat formed in a sidewall of the pouch and having an inner fold, said pouch encircling and closely conforming to the lateral periphery of said stack and protective member with the pleat maintained in flat condition, said pouch having transversely extending end heat seals, one closing the bottom of said pouch and another closing the top of said pouch at a location slightly above said lines of weakness, a cut made through the laminate intermediate the lines of weakness and near the end of the top heat seal toward which the inner fold of the pleat faces, and a sealed area around said cut which is adapted to block gas and vapor transmission from the cut in the laminate to the pouch interior.

* * * * *